US008393700B2

(12) United States Patent
Otsuka et al.

(10) Patent No.: US 8,393,700 B2
(45) Date of Patent: Mar. 12, 2013

(54) INKJET RECORDING DEVICE WITH INDEPENDENTLY CONTROLLABLE LIGHT EMITTING DEVICES

(75) Inventors: Tadakazu Otsuka, Hamamatsu (JP); Fumiyoshi Yoshizawa, Hamamatsu (JP)

(73) Assignee: Roland DG Corporation, Hamamatsu-shi (JP)

( * ) Notice: Subject to any disclaimer, the term of this patent is extended or adjusted under 35 U.S.C. 154(b) by 163 days.

(21) Appl. No.: 12/995,148

(22) PCT Filed: Jun. 3, 2009

(86) PCT No.: PCT/JP2009/060131

§ 371 (c)(1), (2), (4) Date: Feb. 15, 2011

(87) PCT Pub. No.: WO2009/148074

PCT Pub. Date: Dec. 10, 2009

(65) Prior Publication Data

US 2011/0134179 A1 Jun. 9, 2011

(30) Foreign Application Priority Data

Jun. 3, 2008 (JP) ..... 2008-145440

(51) Int. Cl.
*B41J 29/38* (2006.01)

(52) U.S. Cl. ..... 347/9; 347/16; 347/101

(58) Field of Classification Search ..... 347/9, 16, 347/20, 101, 102, 104, 105
See application file for complete search history.

(56) References Cited

U.S. PATENT DOCUMENTS 7,419,256 B2 * 9/2008 Niekawa ..... 347/102
7,600,867 B2 * 10/2009 Mills et al. ..... 347/102

* cited by examiner

*Primary Examiner* — Juanita D Jackson
(74) *Attorney, Agent, or Firm* — Lee, Hong, Degerman, Kang & Waimey

(57) ABSTRACT

An inkjet recording apparatus is presented. The inkjet recording apparatus includes an ink head configured to move in left and right directions, comprising a plurality of nozzles arranged in a front-rear direction for discharging ink on a recording medium, wherein the ink is curable when irradiated with light from a first light emitting device or a second light emitting device, and a conveyor device configured to feed the recording medium in a direction, wherein the first light emitting device is configured to move integrally with the ink head and to apply light to the recording medium, and wherein the second light emitting device, disposed offset from the plurality of nozzles in the front-rear direction, is configured to turn on independent of the first light emitting device and to apply light to the recording medium.

16 Claims, 13 Drawing Sheets

INKJET RECORDING DEVICE WITH INDEPENDENTLY CONTROLLABLE LIGHT EMITTING DEVICES

CROSS-REFERENCE TO RELATED APPLICATIONS

This application is the National Stage filing under 35 U.S.C. 371 of International Application No. PCT/JP2009/060131, filed on Jun. 3, 2009, which claims the benefit of earlier filing date and right of priority to Japanese Application No. 2008-145440, filed on Jun. 3, 2008, the contents of all which are hereby incorporated by reference herein in their entirety.

BACKGROUND OF THE INVENTION

1. Field of the Invention

The present invention relates to an inkjet recording apparatus comprising an ink head for discharging ink that cures when irradiated with light, and a light emitting device for curing the ink.

2. Discussion of the Related Art

A conventional inkjet printer comprises an ink head for discharging ink onto a recording medium, wherein the ink is cured when irradiated with ultraviolet light. The ink is hereinafter referred to as "ultraviolet curable ink." The conventional inkjet printer comprises an ultraviolet light emitting device for applying ultraviolet light to the ink on the recording medium, and an adjusting means for adjusting the timing for the output of the ultraviolet light via the ultraviolet light emitting device. The present application aims to perform a printing operation that is suitable for controlling a viscosity of ink droplets by adjusting the timing for the application of the ultraviolet light by the adjusting means.

The conventional inkjet printer is configured to enable the ultraviolet light emitting device and the ink head to move on the same guide rail. For this reason, the efficiency of a printing operation cannot be ensured because the ink head cannot print while the ultraviolet light emitting device is performing ultraviolet light irradiation.

The prior art has devised a configuration in which a sub-guide rail is additionally disposed in front of and parallel to the guide rail so that the ultraviolet light emitting device can move along the sub-guide rail. However, this configuration limits the timing of the ultraviolet light irradiation to a time after the ink head has performed the printing operation. Accordingly, the surface condition of the ink cannot be changed and a variety of printing operations cannot be performed.

It is an object of the invention to provide an inkjet recording apparatus that allows various combinations of ink printing and light irradiation in order to achieve a wide variety of printing operations.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In accordance with an embodiment, an inkjet recording apparatus is presented. The inkjet recording apparatus includes an ink head configured to move in left and right directions, comprising a plurality of nozzles arranged in a front-rear direction for discharging ink on a recording medium, wherein the ink is curable when irradiated with light from a first light emitting device or a second light emitting device, and a conveyor device configured to feed the recording medium in a direction, wherein the first light emitting device, disposed linearly parallel to the plurality of nozzles, is configured to move integrally with the ink head and to apply light to the recording medium, and wherein the second light emitting device, disposed offset from the plurality of nozzles in the front-rear direction, is configured to turn on independent of the first light emitting device and to apply light to the recording medium.

According to one feature, the length of a light emitting portion of the first light emitting device is equal to the length between a frontmost nozzle of the plurality of nozzles and a rearmost nozzle of the plurality of nozzles. Additionally, the length of a light emitting portion of the second light emitting device is equal to the length between a frontmost nozzle of the plurality of nozzles and a rearmost nozzle of the plurality of nozzles.

According to another feature, an edge of a light emitting portion of the second light emitting device is linearly parallel with an edge of a light emitting portion of the first light emitting device.

According to yet another feature, when performing a print operation, the conveyor device feeds the recording medium frontward at a length equal to or greater than a predetermined minimum feed amount, and an edge of a light emitting portion of the second light emitting device nearest to the plurality of nozzles is offset from an edge of a light emitting portion of the first light emitting device at a distance greater than the predetermined minimum feed amount.

According to still yet another feature, the second light emitting device is configured to move integrally with the ink head. Furthermore, the first light emitting device is positioned to a left side or right side of the ink head, and the second light emitting device is positioned on a side opposite of the position of the first light emitting device.

According to another feature, the inkjet recording apparatus further includes a control device configured to selectively perform a first printing operation for controlling the first light emitting device to be turned on when the ink head discharges the ink, or a second printing operation for controlling the first light emitting device to be turned off and the second light emitting device to be turned on when the ink head discharges the ink. Furthermore, the conveyor device is further configured to move the recording medium rearward, and the control device allows the first light emitting and second light emitting device to be turned off while the recording medium is being moved rearward.

According to yet another feature, the ink head further includes a first print head and a second print head for respectively discharging a first ink and a second ink, wherein the first ink is different from the second ink. Furthermore, the inkjet recording apparatus further includes a control device configured to perform a first printing step for discharging the first ink via the first print head and turning on the first light emitting device when the first print head is discharging the first ink, or a second printing step for discharging the second ink via the second print head and turning off the first light emitting device and turning on the second light emitting device when the second print head is discharging the second ink. Additionally, the According to still yet another feature, the ink head includes a first print head and a second print head for respectively discharging a first ink and a second ink, wherein the first ink is different from the second ink, and the conveyor device is further configured to move the recording medium rearward. Furthermore, the inkjet recording apparatus further includes a control device configured to control the ink head to move in a left and right direction, control the first print head to discharge the first ink while turning on the first light emitting device and move the recording medium frontward in a predetermined front feed amount, move the recording medium rearward in a predetermined rear feed amount, control the ink head to move back and forth a plurality of times in the left and right directions and the second print head to discharge the second ink while turning on the first light emitting device and move the recording medium frontward in the predetermined front feed amount, move the recording medium rearward, and control the ink head to move in a left and right direction and the second print head to discharge the second ink while turning off the first light emitting device and turning on the second light emitting device and move the recording medium frontward in a predetermined front feed amount.

According to still yet another feature, the inkjet recording apparatus further includes a control device configured to selectively perform a first printing operation by turning off the first light emitting device and turning on the second light emitting device when the ink head discharges the ink, and a second printing operation by turning on the first light emitting device when the ink head discharges the ink, wherein the first light emitting device is positioned to the left side or the right side of the ink head, and the second light emitting device is positioned to the side opposite of the position of the ink head.

According to another embodiment, an inkjet recording apparatus is presented. The inkjet recording apparatus includes an ink head configured to move in left and right directions and comprising a plurality of nozzles, arranged in a front-rear direction, for discharging ink on a recording medium, wherein the ink is curable when irradiated with ultraviolet light, a conveyor device configured to move the recording medium frontward a predetermined feed amount, a first light emitting device disposed linearly adjacent to the nozzles and configured to move integrally with the ink head and to apply ultraviolet light to the recording medium, and a second light emitting device, disposed offset from the plurality of nozzles in the front-rear direction, configured to move integrally with the ink head and turn on independently of the first light emitting device, for applying ultraviolet light to the ink discharged from the ink head after the recording medium has been moved frontward the predetermined feed amount.

According to yet another embodiment, a method of printing via an inkjet recording apparatus, the method includes discharging ink on a recording medium via a plurality of nozzles arranged in a front-rear direction located in an ink head configured to move in left and right directions, wherein the ink is curable when irradiated with light from a first light emitting device or a second light emitting device, feeding the recording medium in a direction via a conveyer, applying a first light to the recording medium via a first light emitting device, linearly parallel to the plurality of nozzles and configured to move integrally with the ink head, and applying a second light to the recording medium via a second light emitting device, offset from the plurality of nozzles and configured to turn on independent of the first light emitting device.

These and other embodiments will also become readily apparent to those skilled in the art from the following detailed description of the embodiments having reference to the attached figures, the invention not being limited to any particular embodiment disclosed.

BRIEF DESCRIPTION OF THE DRAWINGS

The above and other aspects, features, and advantages of the present invention will become more apparent upon consideration of the following description of preferred embodiments, taken in conjunction with the accompanying drawing figures.

DETAILED DESCRIPTION OF THE PREFERRED EMBODIMENTS

In the following detailed description, reference is made to the accompanying figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

In the present invention, the term "recording medium" refers to a wide range of recording media, including, but not limited to, recording media made of paper materials such as plain paper, and any media made of resin materials such as PVC and polyesters, metals such as aluminum and iron, wood, and other various materials. In the present invention, the term "inkjet" means a printing system utilizing inkjet technology. The "inkjet" system includes various known techniques, including various continuous type systems such as a binary deflection system and a continuous deflection system, as well as various on-demand systems including a thermal system and a piezoelectric system.

Figure 1:
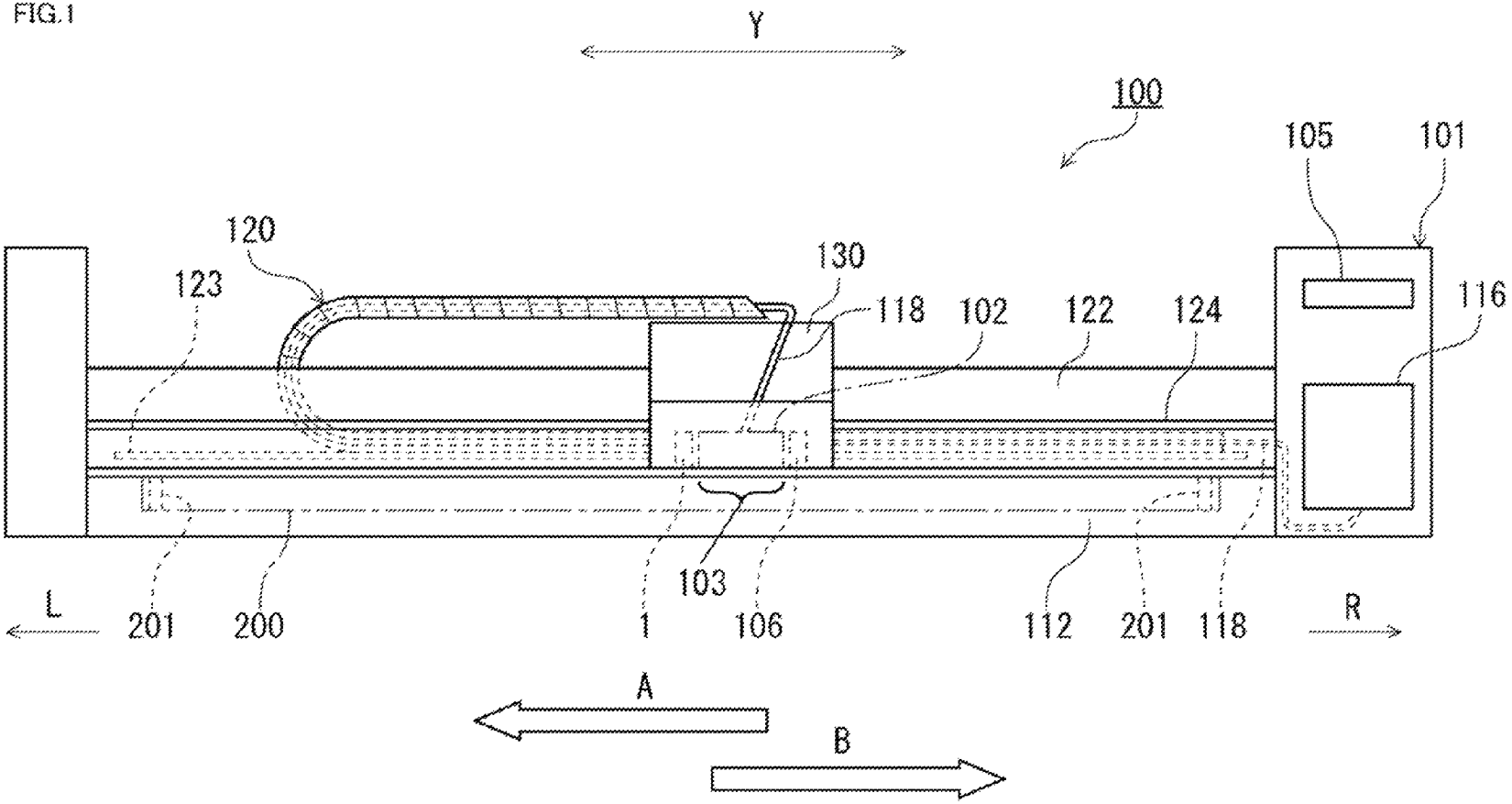
FIG. 1 illustrates a portion of an ink jet printer according to one embodiment of the present invention.

As illustrated in FIG. 1, an inkjet printer 100 includes an apparatus main unit 101 and a guide rail 122 fixed to the apparatus main unit 101. The apparatus main unit 101 is provided with a platen 112 for supporting a recording paper 200. The guide rail 122 extends in the left-right direction, i.e., from side to side. Hereinafter, the left-right (latitude) direction of the guide rail 122 is referred to as a primary scanning direction Y.

A carriage 130 is fitted to the guide rail 122. Rollers are provided at the right side edge and the left side edge of the guide rail 122 (not shown). A belt 124 is wound around the rollers. The carriage 130 is fixed to the belt 124. The carriage 130 moves in the primary scanning direction Y in response to the belt 124. Specifically, the carriage 130 is movable in the primary scanning direction Y along the guide rail 122.

The apparatus main unit 101 includes a pair of upper and lower rollers 201 that are placed on opposite ends of the recording paper 200 (the upper rollers are not shown in FIG. 1). The rollers 201 are configured to be rotatable to move the recording paper 200 in a secondary scanning direction X, which is perpendicular to the primary scanning direction Y. Since the scanning direction Y is the left/right direction, the secondary scanning direction X is the front/rear direction. Reference characters L, R, F, and Re in the drawings represent left, right, front, and rear, respectively.

A plurality of ink tanks 116 are attached to the apparatus main unit 101. Each one of the ink tanks 116 is detachable from the apparatus main unit 101, and is configured as an ink cartridge. Each one of the ink tanks 116 stores ultraviolet curable ink. More specifically, according to one embodiment, the apparatus main unit 101 may be provided with six ink tanks 116. The ink tanks 116 may respectively store cyan, magenta, yellow, and black inks, which are process color inks, a white ink, which is a spot color ink, and a clear ink, which is a transparent ink.

Figure 2:
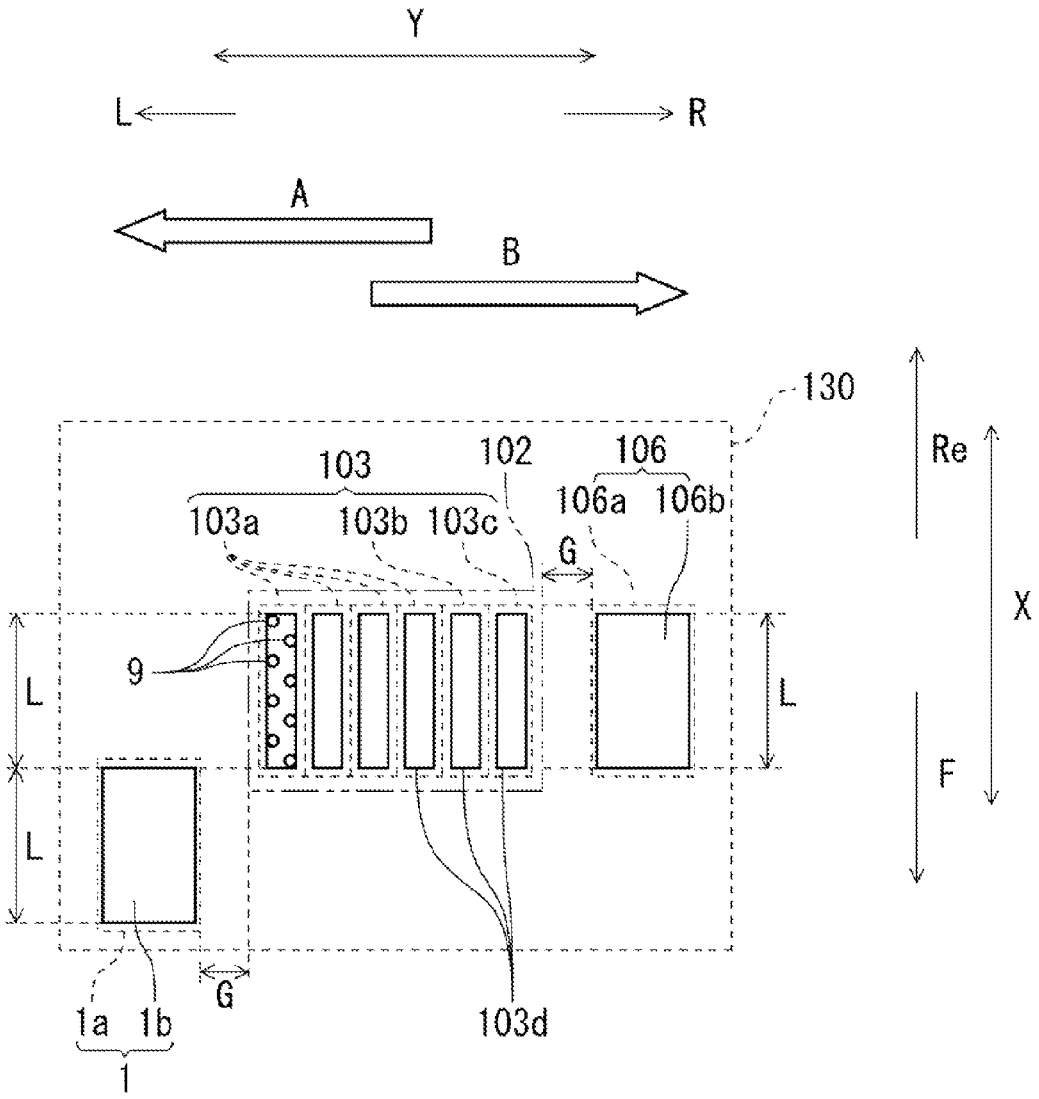
FIG. 2 illustrates the positional relationship between an ink head and light emitting devices according to one embodiment of the present invention.

The carriage 130 incorporates an ink head 102. As illustrated in FIG. 2, the ink head 102 has a plurality of print heads 103 corresponding to the ink tanks 116. More specifically, the ink head 102 may comprise four print heads 103*a* for discharging the process color inks, a print head 103*b* for discharging the clear ink, and a print head 103*c* for discharging the white ink. Note that the process color inks and the white ink correspond to the first ink, and the clear ink corresponds to the second ink. The print heads 103*a*, 103*b*, and 103*c* are arranged along the primary scanning direction Y. The order of arrangement of the print head 103*a*, 103*b*, and 103*c* is not particularly limited.

A plurality of nozzles 9 for discharging ink are provided in the lower face of each of the print heads 103. The plurality of nozzles 9 are arranged in the front-rear direction to form a nozzle array. The nozzles 9 are not limited to a specific number of rows of nozzles and may include two or more rows of nozzles.

As illustrated in FIG. 2, the nozzles 9 may be arrayed in a staggered arrangement. It should be noted that in FIG. 2, only the nozzles 9 of the leftmost one of the print heads 103*a* are depicted, and the nozzles 9 of the rest of the print heads 103*a* and the other print heads 103*b* and 103*c* are not shown. Likewise, the illustration of the nozzles 9 is simplified in subsequent figures. The actual number of the nozzles 9 may be greater than or less than that shown in FIG. 2.

The region between the frontmost nozzle of the nozzles 9 and the rearmost nozzle of the nozzles 9 is the maximum region in which each of the print heads 130 can discharge the ink per one time of scanning Hereinafter, this region is referred to as a printing area 103*d*. From each of the print heads 130, ink is discharged within the printing area 103*d*.

As illustrated in FIG. 1, the print heads 103 are connected to the respective ink tanks 116 via respective ink supply tubes 118 (only one tube is shown in FIG. 1). Each of the ink supply tubes 118 is accommodated in a cableveyor 120 that is deformable. The cableveyor 120 is retained by a retaining member 123 extending in the primary scanning direction Y.

The inkjet printer 100 emits ultraviolet light via a first ultraviolet lamp 106 and a second ultraviolet lamp 1. The first ultraviolet lamp 106 is disposed to the right side of the ink head 102, and moves integrally with the ink head 102. The first ultraviolet lamp 106 may be disposed between any two of the plurality of the print heads 103*a*, 103*b*, and 103*c*. For example, the first ultraviolet lamp 106 may be disposed between the print head 103*a* and the print head 103*b*.

As illustrated in FIG. 2, the second ultraviolet lamp 1 is disposed obliquely to the left and in front of the ink head 102. The second ultraviolet lamp 1 moves integrally with the ink head 102. The ink head 102 and the first ultraviolet lamp 106 are spaced at a gap G. The left-light gap between the ink head 102 and the second ultraviolet lamp 1 is the same width as the gap G.

In the present embodiment, the ultraviolet lamps 106 and 1 are made of LED (Light Emitting Diode) lamps that emit ultraviolet light. The ultraviolet lamps 106 and 1 are not limited to LED lamps.

The ultraviolet lamps 106 and 1 have box-shaped lamp main units 106*a* and 1*a*, respectively, and light emitting portions 106*b* and 1*b*, respectively, that emit ultraviolet light. Each box-shaped lamp main unit and light emitting portion is provided at the center of the lower face of the main units. With respect to the front-rear direction, the rear edge of the light emitting portion 1*b* of the second ultraviolet lamp 1 is at the same position as the front edge of the light emitting portion 106*b* of the first ultraviolet lamp 106. In other words, the rear edge of the light emitting portion 1*b* is positioned on the left-right axis that passes through the front edge of the light emitting portion 106*b*.

Accordingly, the rear edge of the light emitting portion 1*b* may be positioned more frontward than the front edge of the light emitting portion 106*b*. The gap between the front edge of the light emitting portion 106*b* and the rear edge of the light emitting portion 1*b*, with respect to the front-rear direction, may be equal to or greater than the minimum feed amount of the recording paper 200. This ensures sufficient time from the moment when ink has been discharged until the moment when the ultraviolet irradiation is initiated by the second ultraviolet lamp 1. The surface condition of the ink on the recording paper 200 may vary depending on the time elapsed from the moment when ink was discharged until the moment of ultraviolet light irradiation. Thus, a variety of printing operations with different printing states can be performed by changing the gap between the front edge of the light emitting portion 106*b* and the rear edge of the light emitting portion 1*b*.

The front-to-rear length of the light emitting portions 106*b* and 1*b* of the ultraviolet lamps 106 and 1 and the front-to-rear length of the printing area 103*d* of the ink head 102 are both set at a size L, such that they are equal to each other. This allows the light emitting portions 106*b* and 1*b* to apply ultraviolet light to all the ink discharged from the print head 103 in one scanning period. It should be noted that the front-to-rear length of the light emitting portions 106*b* and 1*b* of the ultraviolet lamps 106 and 1 may be longer than the front-to-rear length of the printing area 103*d* of the ink head 102.

As illustrated in FIG. 1, the apparatus main unit 101 has a control device 105 for controlling the operations of various parts of the inkjet printer 100. The control device 105 may control movement of the carriage 130, feeding of the recording paper 200, ink discharge from the ink head 102, and light irradiation by the first ultraviolet lamp 106 and the second ultraviolet lamp 1.

Printing on the recording paper 200 will now be described. The inkjet printer 100 may print via only process color inks, process color inks and white ink, or a combination of process color inks, white ink, and clear ink. The present embodiment, as well as the later-described embodiments, describe printing via process color inks and white ink ("first ink") and clear ink ("second ink").

Printing using the first and second inks is conducted by the first and second printing steps. The first printing step includes forming an image on the recording paper 200 with the first ink. The second printing step includes overcoating the second ink on the recording paper 200 on which an image has been formed in the first printing step. In each of the printing steps, the ink head 102 discharges ink while moving in the primary scanning direction Y. Ink is discharged from at least one of the nozzles 9 of at least one of the plurality of the print heads 103*a*, 103*b*, and 103*c*. The ink head 102 may discharge ink only when it moves from one side to the other side in one of the primary scanning directions Y, or alternatively, the ink head 102 may discharge ink both when it moves from one side to the other side in one of the primary scanning directions and when it moves back from the other side to the one side in the other primary scanning direction. Hereafter, the printing operation which discharges ink only when the ink head moves from one end to the other in one of the primary scanning directions Y is referred to as "unidirectional printing." Additionally, the printing operation in which ink is discharged in both of the directions is referred to as "bidirectional printing."

In each of the printing steps, the recording paper 200 is fed frontward, step by step, in a predetermined feed amount. In other words, every time the ink head 102 moves back and forth one time, the recording paper 200 is fed frontward in a predetermined feed amount. In the present embodiment, when the first printing step is completed, the recording paper 200 is fed rearward by a predetermined amount, and the second printing step is initiated. It is possible to continuously repeat the first printing step and the second printing step.

Specifically, after executing a step from the first printing step, a step from the second printing step may be executed without feeding the recording paper 200, and thereafter the recording paper 200 may be fed frontward in a predetermined feed amount. The first step and the second step may be repeated in the same manner. Specifically, after the first ink is discharged and cured the second ink is immediately discharged over the cured first and the recording paper 200 is fed frontward.

In the first printing step, the first ultraviolet lamp 106 and the second ultraviolet lamp 1 are lit at all times. The printing in the first printing step may be either unidirectional printing or bidirectional printing. In the case of unidirectional printing, the carriage 130 is moved in the forward direction A from the initial position, and ink is discharged from the print heads 103*a* and 103*c* onto the recording paper 200. Ultraviolet light is applied from the first ultraviolet lamp 106 immediately thereafter. As a result, the inks are rapidly cured and fixed on the recording paper 200. Thereafter, the carriage 130 is moved in the return direction B to return to the initial position. It should be noted, however, that both the first ultraviolet lamp 106 and the second ultraviolet lamp 1 may not necessarily be lit at all times in the first printing step. Various patterns are possible for the illumination states of the first and second ultraviolet lamps 160 and 1.

When the first printing step is completed, the recording paper 200 is fed backwards, and the second printing step is initiated. In the second printing step, clear ink is output to provide the image formed via the first printing step with a desired finish, such as a gloss. The ink head 102 discharges clear ink from the print head 103*b* while moving in a primary scanning direction Y. The ink head 102 moves in the forward direction A from the initial position and thereafter moves in the return direction B to return to the initial position. When the ink head 102 returns to the initial position, the recording paper 200 is fed frontward by a predetermined feed amount. Thereafter, the operations described above are repeated until the printing is completed.

Both unidirectional printing and bidirectional printing are possible in the second printing step. Additionally, the illumination patterns of the first and second ultraviolet lamps 160 and 1 may be varied for each of the unidirectional printing and the bidirectional printing. These methods will be described below.

Figure 3:
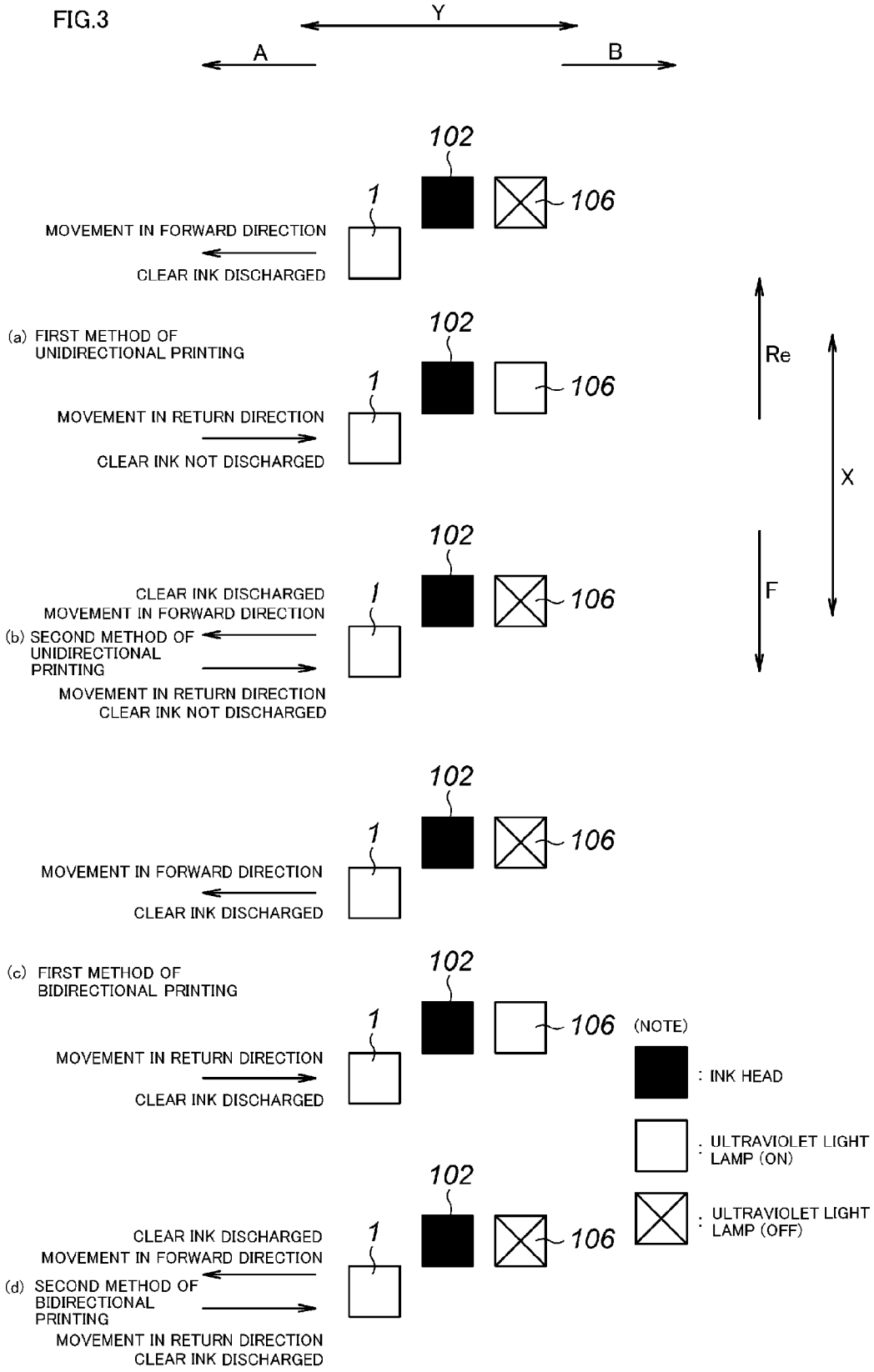
FIG. 3 illustrates illumination states of the light emitting devices according to one embodiment of the present invention.

FIG. 3(*a*) illustrates a first method of the unidirectional printing. In the first method, the first ultraviolet lamp 106 is off during movement in the forward direction A, and the first ultraviolet lamp 106 is lit during movement in the return direction B. The second ultraviolet lamp 1 is lit during movement in the forward direction A and during movement in the return direction B. In this method, the clear ink that has been discharged during the movement in the forward direction A is cured by the first ultraviolet lamp 106 during the movement in the return direction B. Additionally, after the recording paper 200 has been fed frontward, the clear ink is further cured by the second ultraviolet lamp 1 during the movement in the forward direction A and the return direction B. In this method, the clear ink is cured by the first ultraviolet lamp 106 after a predetermined time has elapsed from the moment when the ink is discharged and after the surface has become smooth. The example above lessens the roughness of the printed surface by the clear ink, and achieves a more glossy printing. As illustrated in FIG. 3(*b*), in the second method of unidirectional printing, the first ultraviolet lamp 106 is turned off and the second ultraviolet lamp 1 is lit both when the ink head 102 moves in the forward direction A and when it moves in the return direction B. In this method, application of ultraviolet light to the clear ink is only performed by the second ultraviolet lamp 1. Accordingly, more time is given for the ultraviolet irradiation after the discharge of the ink.

The aforementioned methods have been described for unidirectional printing. However, it is possible to use the methods for bidirectional printing, as illustrated in FIGS. 3(*c*) and 3(*d*). The clear ink can be output on the recording paper 200 twice by discharging the clear ink both in the forward direction A and in the return direction B, and as a result, the glossiness of the printed material is further enhanced.

As described above, in the present embodiment, the application of ultraviolet light to the clear ink does not begin immediately after the output of the ink, rather ultraviolet light is output after a predetermined time. Accordingly, a more glossy finish may be achieved when the ink is output after a predetermined time after the surface condition has been made smooth.

Additionally, according to the present embodiment, the clear ink can be cured by the first ultraviolet lamp 106 or the second ultraviolet lamp 1 while the clear ink is being discharged from the print head 103*b*.

The printing method by the inkjet printer 100 according to the present embodiment is not limited to the foregoing methods. The inkjet printer 100 achieves a variety of printing operations because the first ultraviolet lamp 106 is disposed at a side of the ink head 102, the second ultraviolet lamp 1 is disposed more frontward than the ink head 102, and the first ultraviolet lamp 106 and the second ultraviolet lamp 1 are capable of being independently controlled. Specifically, the foregoing methods allow for a variety of printing operations with various finishes.

The inkjet printer 100 according to the present embodiment allows for the application of ultraviolet light to the clear ink immediately after the clear ink has been discharged from the print head 103*b*. For example, when performing unidirectional printing using clear ink, the first ultraviolet lamp 106 may be continuously lit while discharging the clear ink, thereby, the printing is performed with a relatively large surface roughness, which results in a reduced glossiness.

In addition, the inkjet printer 100, according to the present embodiment, may divide the second step into a step of discharging clear ink and applying ultraviolet light and a step of solely applying ultraviolet light. For example, first, clear ink is discharged from the second print head 103*b* while the ink head 102 is being moved in a left and right direction with at least the first ultraviolet lamp 106 being lit. This operation is repeated while feeding the recording paper 200 frontward. As a result, clear ink is printed over the required area of the recording paper 200, and, the clear ink is cured. Next, the recording paper 200 is continuously fed rearward until it has returned to the printing start position.

Thereafter, with the first ultraviolet lamp 106 being turned off and the second ultraviolet lamp 1 being turned on, the ink head 102 is moved in the left and right directions while the clear ink is discharged from the second print head 103*b*, and the recording paper 200 is fed frontward. As a result, the surface of the clear ink is finished with a glossier result. Note that the control device 105 allows the first ultraviolet lamp 106 and the second ultraviolet lamp 1 to be turned off while the recording paper 200 is being fed rearward.

Figure 4:
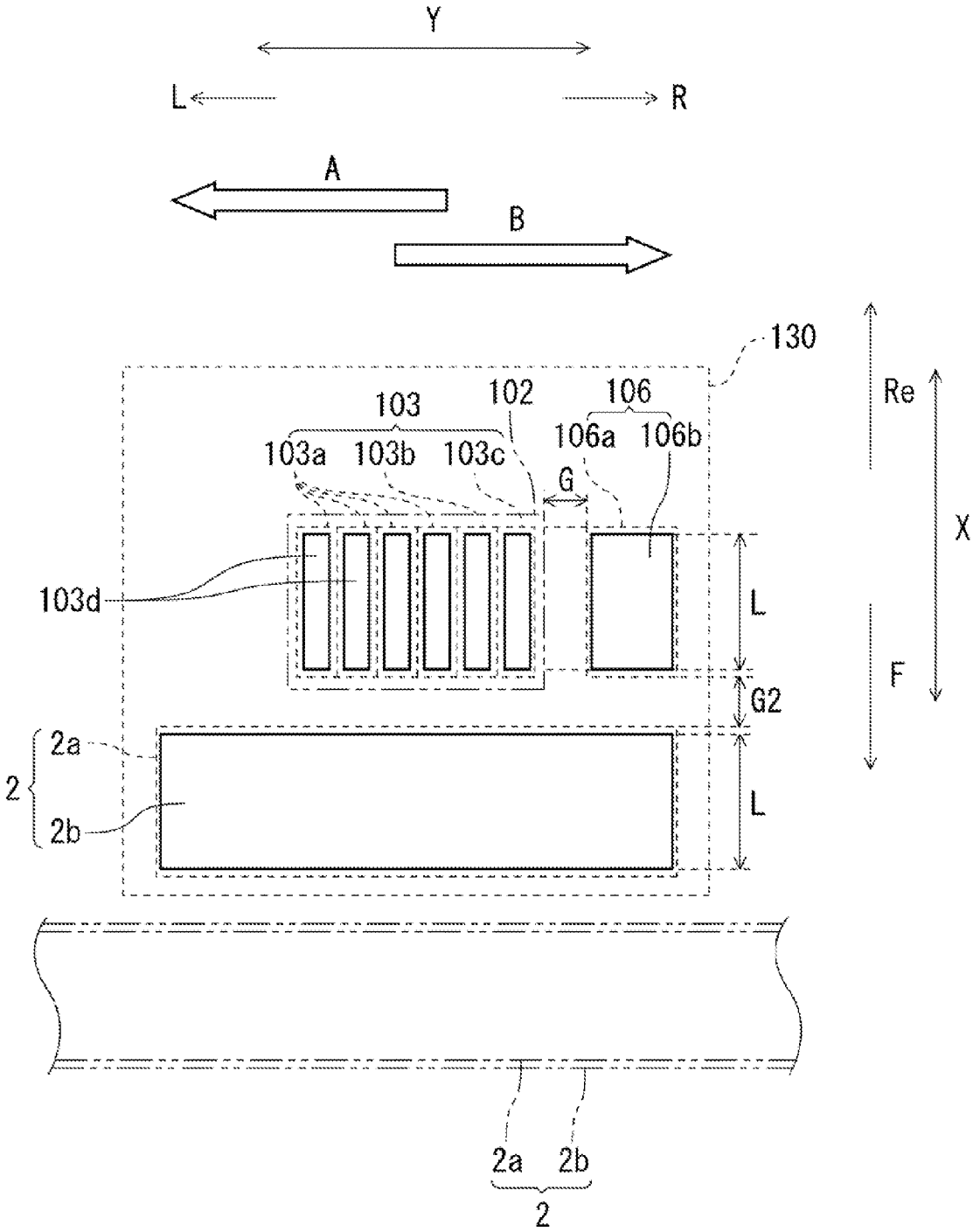
FIG. 4 illustrates the positional relationship between an ink head and a light emitting device according to one embodiment of the present invention.

As illustrated in FIG. 4, an ultraviolet lamp unit 2 that is elongated in the primary scanning direction Y may be utilized in the printing operation. The ultraviolet lamp unit 2 may have a box-shaped main body 2*a* and a light emitting portion 2*b* containing a plurality of ultraviolet lamps arrayed in a primary scanning direction Y at a predetermined gap. The ultraviolet lamp unit 2 is disposed more frontward than the ink head 102 and the first ultraviolet lamp 106. A gap G2 is provided between the rear edge of the ultraviolet lamp unit 2 and the front edge of the first ultraviolet lamp 106.

The gap G2 is set to be equal to or greater than the minimum feed amount of the recording paper 200. Thus, by setting the gap G2 to be equal to or greater than the minimum feed amount, it is possible to ensure sufficient time from which the ink is discharged to the time the ink is cured by the ultraviolet lamp unit 2. The gap G2 may be less than the minimum feed amount.

The ultraviolet lamp unit 2 may move independent of the carriage 130. For example, the ultraviolet lamp unit 2 may be fixed to the apparatus main unit 101 so as to be independently movable with regard to the carriage 130. In this example, it is preferable that the ultraviolet lamp unit 2 be provided across the entirety of the recording paper 200 along the primary scanning direction Y.

The ultraviolet lamp unit 2 in the present embodiment is configured such that a plurality of ultraviolet lamps may be arranged in the primary scanning direction Y. Therefore, a sufficient amount of ultraviolet irradiation can be ensured, and, the ink output on the recording paper 200 can be efficiently cured. Moreover, by appropriately setting the value of the gap G2, it is possible to prevent a situation in which the ultraviolet light applied from the ultraviolet lamp unit 2 is emitted, or leaked, around the side of the ink head 102.

The present embodiment also performs the previously disclosed first and second printing steps. In the first printing step, an image may be formed on the recording paper 200 and both the first ultraviolet lamp 106 and the ultraviolet lamp unit 2 may be lit. However, the illumination pattern of the first ultraviolet lamp 106 and the ultraviolet lamp unit 2 are not limited to a predetermined pattern.

Additionally, in the second printing step, the illumination states of the first ultraviolet lamp 106 and the ultraviolet lamp unit 2 may vary.

Figure 5:
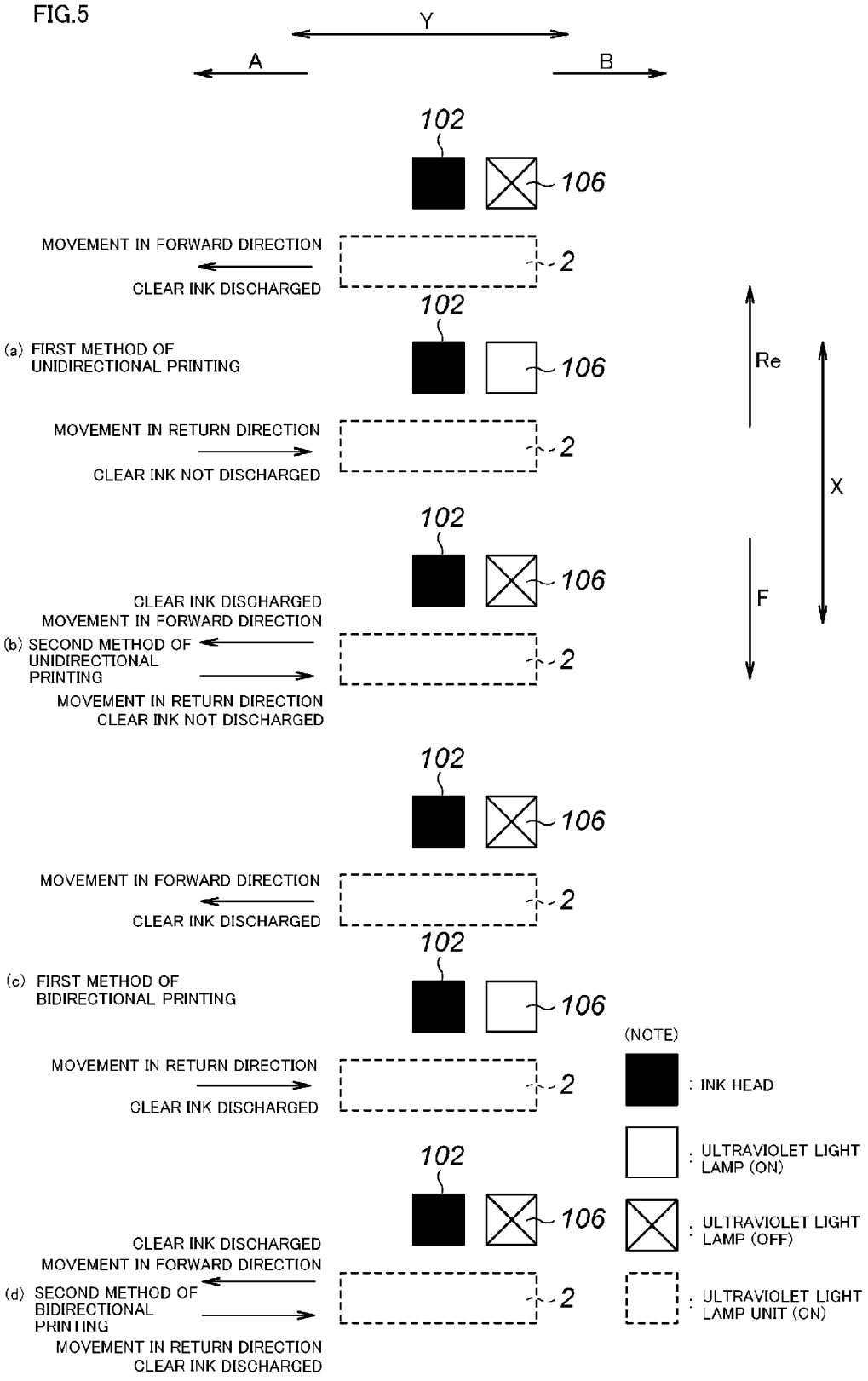
FIG. 5 illustrates illumination states of the light emitting devices according to one embodiment of the present invention.

For example, as illustrated in FIG. 5(*a*), in a first method of unidirectional printing, the ultraviolet lamp 106 is turned off when moving in the forward direction A, whereas the ultraviolet lamp 106 is lit when moving in the return direction B. The ultraviolet lamp unit 2 is lit both when moving in the forward direction A and when moving in the return direction B. As illustrated in FIG. 5(*b*), in a second method of unidirectional printing, the first ultraviolet lamp 106 is turned off and the ultraviolet lamp unit 2 is lit when moving in the forward direction A and when moving in the return direction B.

As illustrated in FIG. 5(*c*), in a first method of unidirectional printing, the ultraviolet lamp 106 is turned off when moving in the forward direction A, whereas the ultraviolet lamp 106 is lit when moving in the return direction B. The ultraviolet lamp unit 2 is lit when moving in the forward direction A and when moving in the return direction B. As illustrated in FIG. 5(*d*), in a second method of bidirectional printing, the first ultraviolet lamp 106 is turned off but the ultraviolet lamp unit 2 is lit when moving in the forward direction A and when moving in the return direction B.

Figure 6:
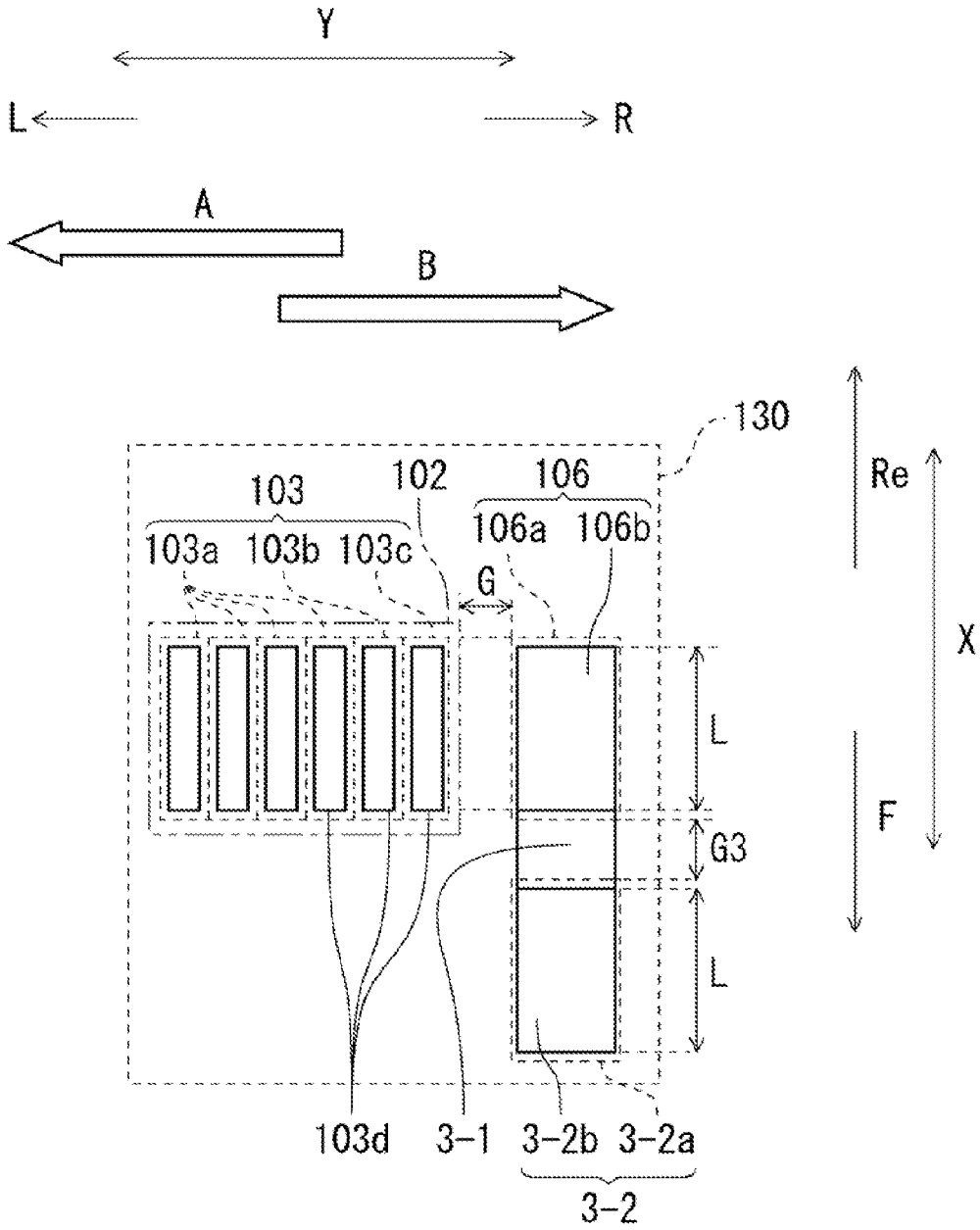
FIG. 6 illustrates the positional relationship between an ink head and a light emitting device according to one embodiment of the present invention.

When two ultraviolet lamps are used as the light irradiation means, the second ultraviolet lamp may be disposed in the manner illustrated in FIG. 6. Specifically, as illustrated in FIG. 6, a second ultraviolet lamp 3-2 may be disposed in front of the first ultraviolet lamp 106. In this embodiment, the second ultraviolet lamp 3-2 is disposed spaced apart from the first ultraviolet lamp 106 at a gap 3-1 having a width G3 with respect to the front-rear direction. The width G3 of the gap 3-1 is set in a manner to prevent the leakage of light from the ultraviolet lamps 106 and 3-2 from adversely affecting each other. It is also possible to provide a shielding member between the ultraviolet lamps 106 and 3-2. The shielding member may replace the gap 3-1 or be placed in conjunction with the gap 3-1.

The present embodiment also performs the first and second printing steps. In the first printing step, for example, both the first ultraviolet lamp 106 and the second ultraviolet lamp 3-2 are lit. The pattern of illumination states of the first ultraviolet lamp 106 and the second ultraviolet lamp 3-2 are not limited to a particular pattern.

Additionally, the second printing step may utilize a plurality of methods in which the patterns of illumination states of the first ultraviolet lamp 106 and the second ultraviolet lamp 3-2 are varied.

Figure 7:
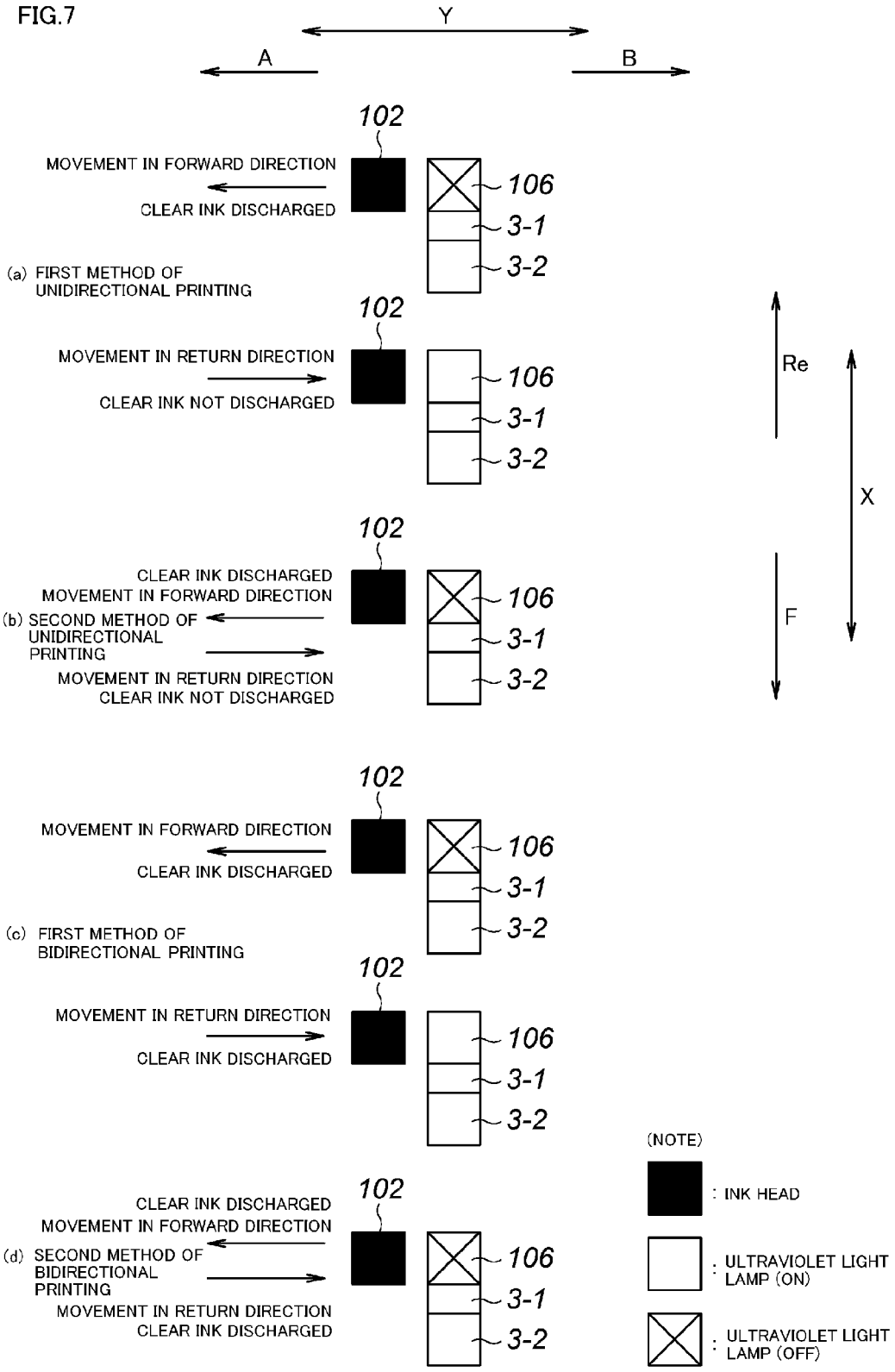
FIG. 7 illustrates illumination states of the light emitting devices according to one embodiment of the present invention.

For example, as illustrated in FIG. 7(*a*), in the first method of unidirectional printing, the first ultraviolet lamp 106 is turned off when moving in the forward direction A, but the first ultraviolet lamp 106 is lit when moving in the return direction B. The second ultraviolet lamp 3-2 is lit when moving in the forward direction A and when moving in the return direction B. As illustrated in FIG. 7(*b*), in the second method of unidirectional printing, the first ultraviolet lamp 106 is turned off and the second ultraviolet lamp 3-2 is lit when moving in the forward direction A and when moving in the return direction B.

As illustrated in FIG. 7(*c*), in the first method of bidirectional printing, the first ultraviolet lamp 106 is turned off when moving in the forward direction A, and the first ultraviolet lamp 106 is lit when moving in the return direction B. The second ultraviolet lamp 3-2 is lit when moving in the forward direction A and when moving in the return direction B. As illustrated in FIG. 7(*d*), in the second method of bidirectional printing, the first ultraviolet lamp 106 is turned off and the second ultraviolet lamp 3-2 is lit when moving in the forward direction A and when moving in the return direction B.

Figure 8:
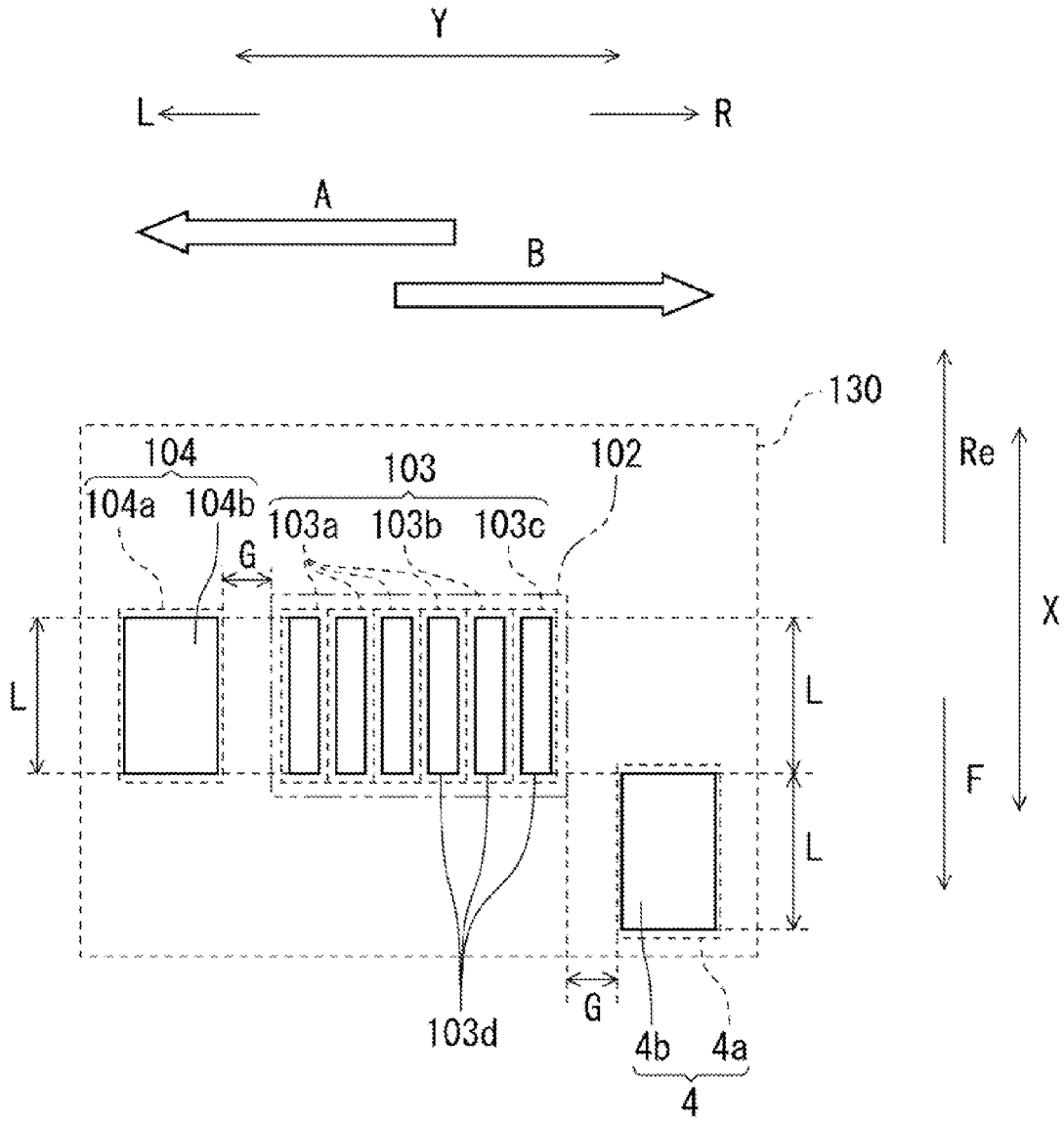
FIG. 8 illustrates the positional relationship between an ink head and a light emitting device according to one embodiment of the present invention.

According to another embodiment of the present invention, the two ultraviolet lamps may be disposed in the manner illustrated in FIG. 8. As illustrated in FIG. 8, a first ultraviolet lamp 104 is disposed to the left side of the ink head 102 and spaced at a gap having a width G. A second ultraviolet lamp 4 is disposed obliquely to the right and in front of the ink head 102 so that the rear edge of its light emitting portion 4*b* is on the same plane as the front edge of a light emitting portion 104*b* of the first ultraviolet lamp 104. The left-light gap between the ink head 102 and the second ultraviolet lamp 4 is set at a width G.

The first and second printing steps are also performed in the present embodiment. In the first printing step, for example, both the first ultraviolet lamp 104 and the second ultraviolet lamp 4 may be lit. However, the pattern of illumination states of the first ultraviolet lamp 104 and the second ultraviolet lamp 4 is not limited to a particular pattern.

Additionally, the second printing step may comprise a plurality of methods in which the patterns of illumination states of the first ultraviolet lamp 104 and the second ultraviolet lamp 4 are varied.

Figure 9:
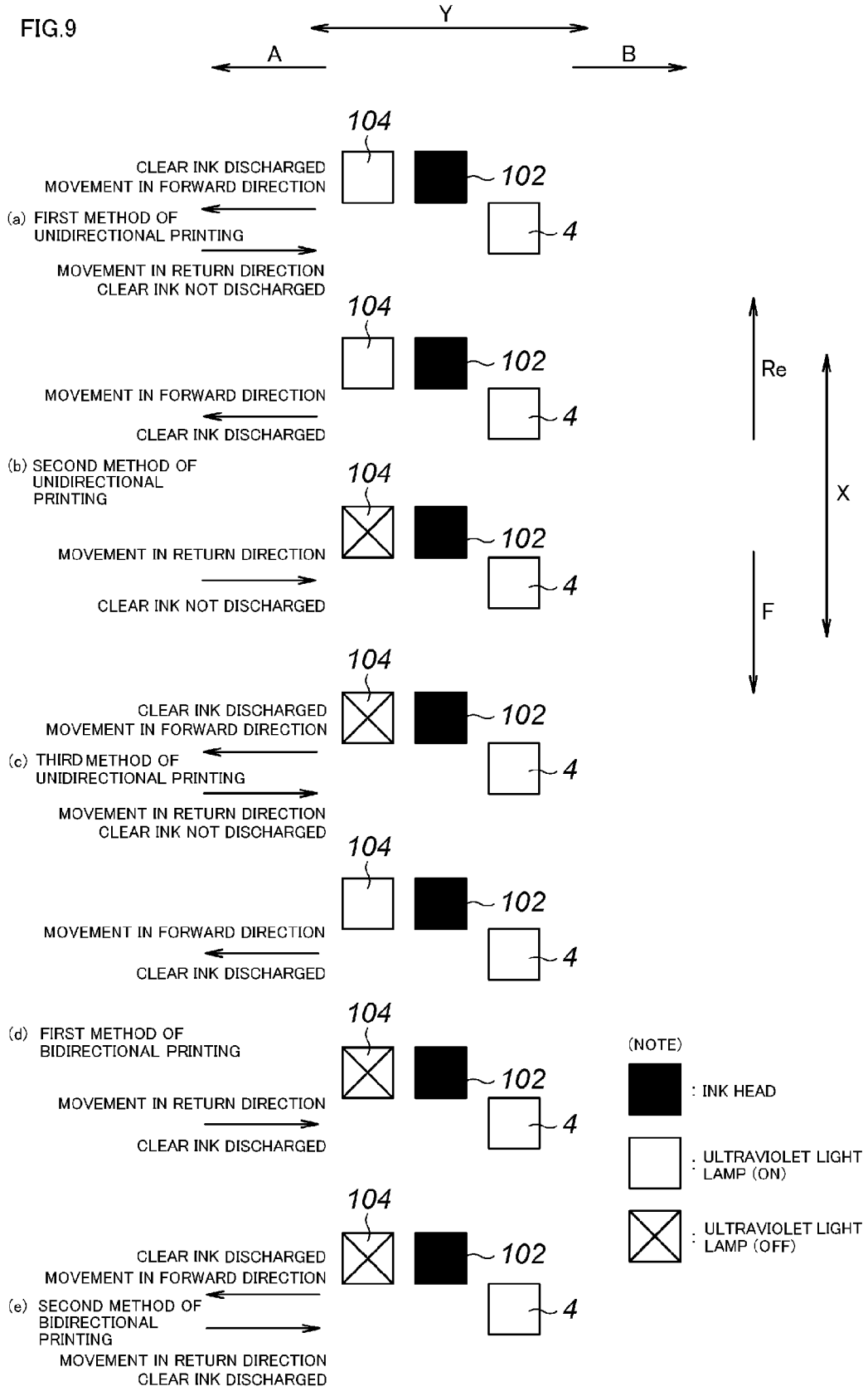
FIG. 9 illustrates illumination states of the light emitting devices according to one embodiment of the present invention.

For example, as illustrated in FIG. 9(*a*), in the first method of unidirectional printing, the first ultraviolet lamp 104 and the second ultraviolet lamp 4 are both lit when moving in the forward direction A and when moving in the return direction B. As illustrated in FIG. 9(*b*), in the second method of unidirectional printing, the first ultraviolet lamp 104 is lit when moving in the forward direction A, and the first ultraviolet lamp 104 is turned off when moving in the return direction B. The second ultraviolet lamp 4 is lit when moving in the forward direction A and when moving in the return direction B. As illustrated in FIG. 9(*c*), in the third method of unidirectional printing, the first ultraviolet lamp 104 is turned off and the second ultraviolet lamp 4 is lit when moving in the forward direction A and when moving in the return direction B.

As illustrated in FIG. 9(*d*), in the first method of bidirectional printing, the first ultraviolet lamp 104 is lit when moving in the forward direction A, and the first ultraviolet lamp 104 is turned off when moving in the return direction B. The second ultraviolet lamp 4 is lit both when moving in the forward direction A and when moving in the return direction B. As illustrated in FIG. 9(*e*), in the second method of bidirectional printing, the first ultraviolet lamp 104 is turned off and the second ultraviolet lamp 4 is lit when moving in the forward direction A and when moving in the return direction B.

Figure 10:
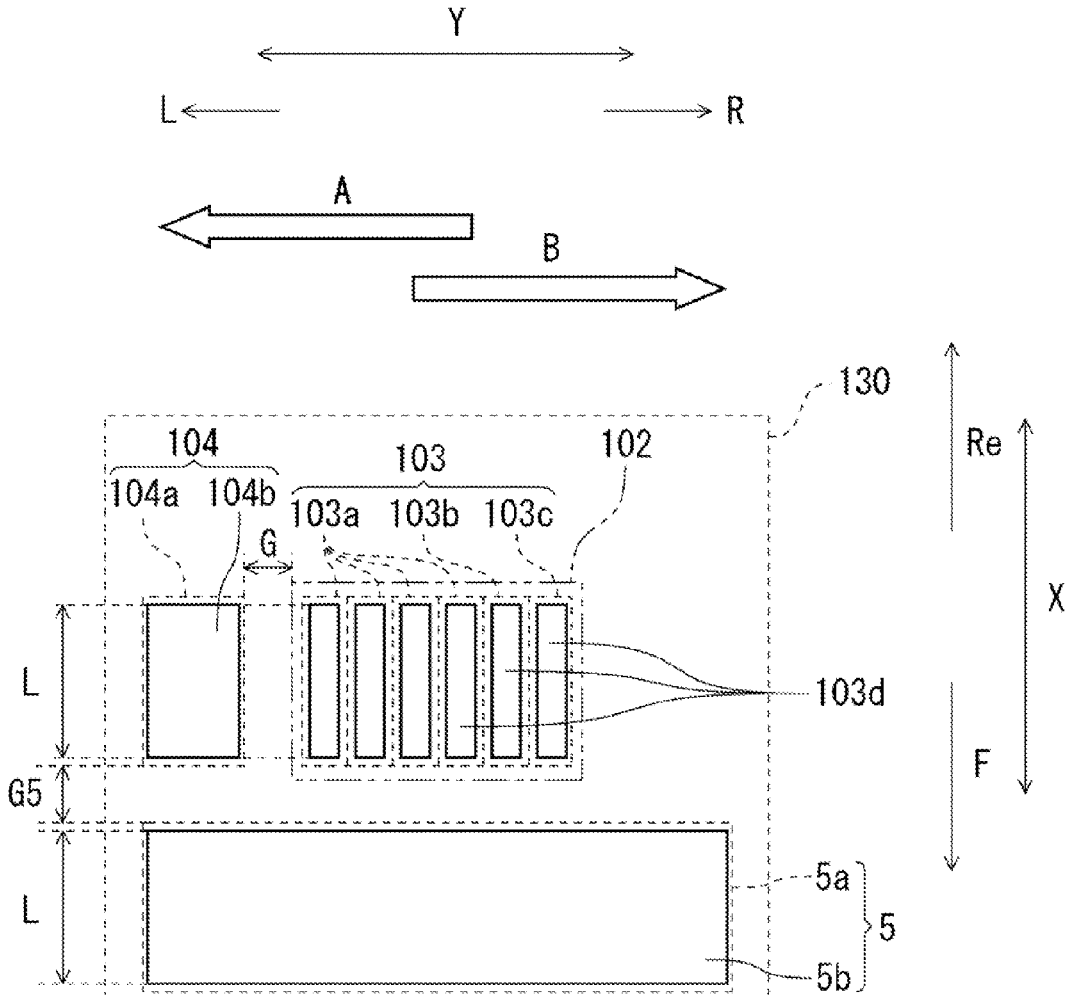
FIG. 10 illustrates the positional relationship between an ink head and a light emitting device according to one embodiment of the present invention.

According to another embodiment, as illustrated in FIG. 10, the first ultraviolet lamp 104 may be disposed to the left side of the ink head 102. A gap G5 is provided between the rear edge of an ultraviolet lamp unit 5 and the front edge of the first ultraviolet lamp 104. Here, the ultraviolet lamp unit 5 is elongated in the primary scanning direction Y, similar to the ultraviolet lamp unit 2 of FIG. 4.

The first and second printing steps are also performed in the present embodiment. In the first printing step, for example, both the first ultraviolet lamp 104 and the ultraviolet lamp unit 5 may be lit. However, the pattern of illumination states of the first ultraviolet lamp 104 and the ultraviolet lamp unit 5 are not limited to a particular state.

Additionally, the second printing step may comprise a plurality of methods in which the patterns of illumination states of the first ultraviolet lamp 104 and the ultraviolet lamp unit 5 are varied.

Figure 11:
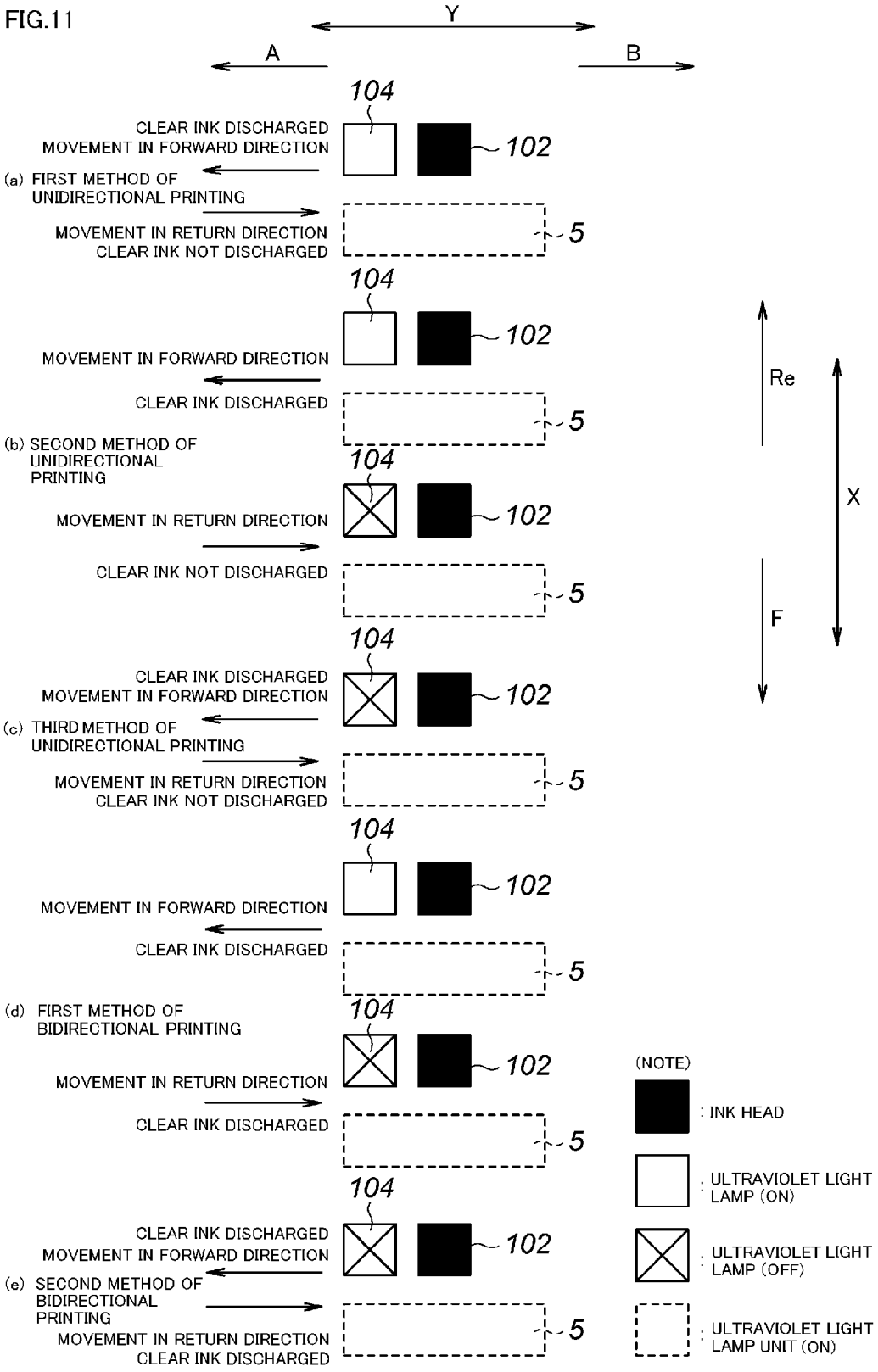
FIG. 11 illustrates illumination states of the light emitting devices according to one embodiment of the present invention.

For example, as illustrated in FIG. 11(*a*), in the first method of unidirectional printing, the first ultraviolet lamp 104 and the ultraviolet lamp unit 5 are both lit when moving in the forward direction A and when moving in the return direction B. As illustrated in FIG. 11(*b*), in the second method of unidirectional printing, the first ultraviolet lamp 104 is lit when moving in the forward direction A, and the first ultraviolet lamp 104 is turned off when moving in the return direction B. The ultraviolet lamp unit 5 is lit both when moving in the forward direction A and when moving in the return direction B. As illustrated in FIG. 11(*c*), in the third method of unidirectional printing, the first ultraviolet lamp 104 is turned off but the ultraviolet lamp unit 6 is lit when moving in the forward direction A and when moving in the return direction B.

As illustrated in FIG. 11(*d*), in the first method of bidirectional printing, the first ultraviolet lamp 104 is lit when moving in the forward direction A, and the first ultraviolet lamp 104 is turned off when moving in the return direction B. The ultraviolet lamp unit 5 is lit when moving in the forward direction A and when moving in the return direction B. As illustrated in FIG. 11(*e*), in the second method of bidirectional printing, the first ultraviolet lamp 104 is turned off and the ultraviolet lamp unit 5 is lit when moving in the forward direction A and when moving in the return direction B.

Figure 12:
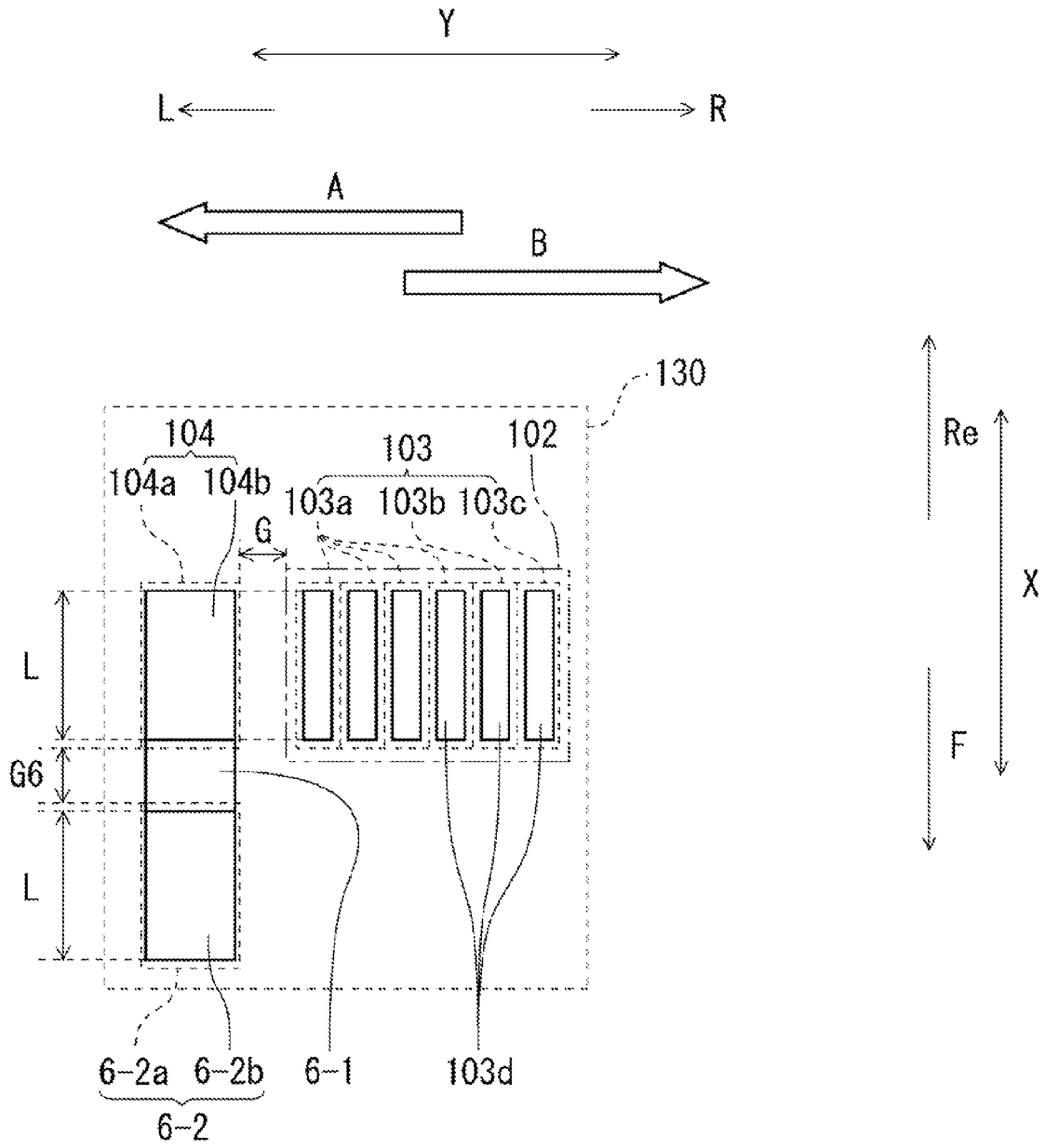
FIG. 12 illustrates the positional relationship between an ink head and a light emitting device according to one embodiment of the present invention.

According to another embodiment, as illustrated in FIG. 12, the first ultraviolet lamp 104 and a second ultraviolet lamp unit 6-2 may be disposed to the left side of the ink head 102. The second ultraviolet lamp 6-2 is disposed in front of the first ultraviolet lamp 104. The gap 6-1 between the second ultraviolet lamp 6-2 and the first ultraviolet lamp 104 is set at a width G6.

The first and second printing steps are also performed in the present embodiment. In the first printing step, for example, both the first ultraviolet lamp 104 and the second ultraviolet lamp 6-2 are lit. However, the pattern of illumination states of the first ultraviolet lamp 104 and the second ultraviolet lamp 6-2 is not limited to a particular pattern.

Additionally, the second printing step may comprise a plurality of methods in which the patterns of illumination states of the first ultraviolet lamp 104 and the second ultraviolet lamp 6-2 are varied.

Figure 13:
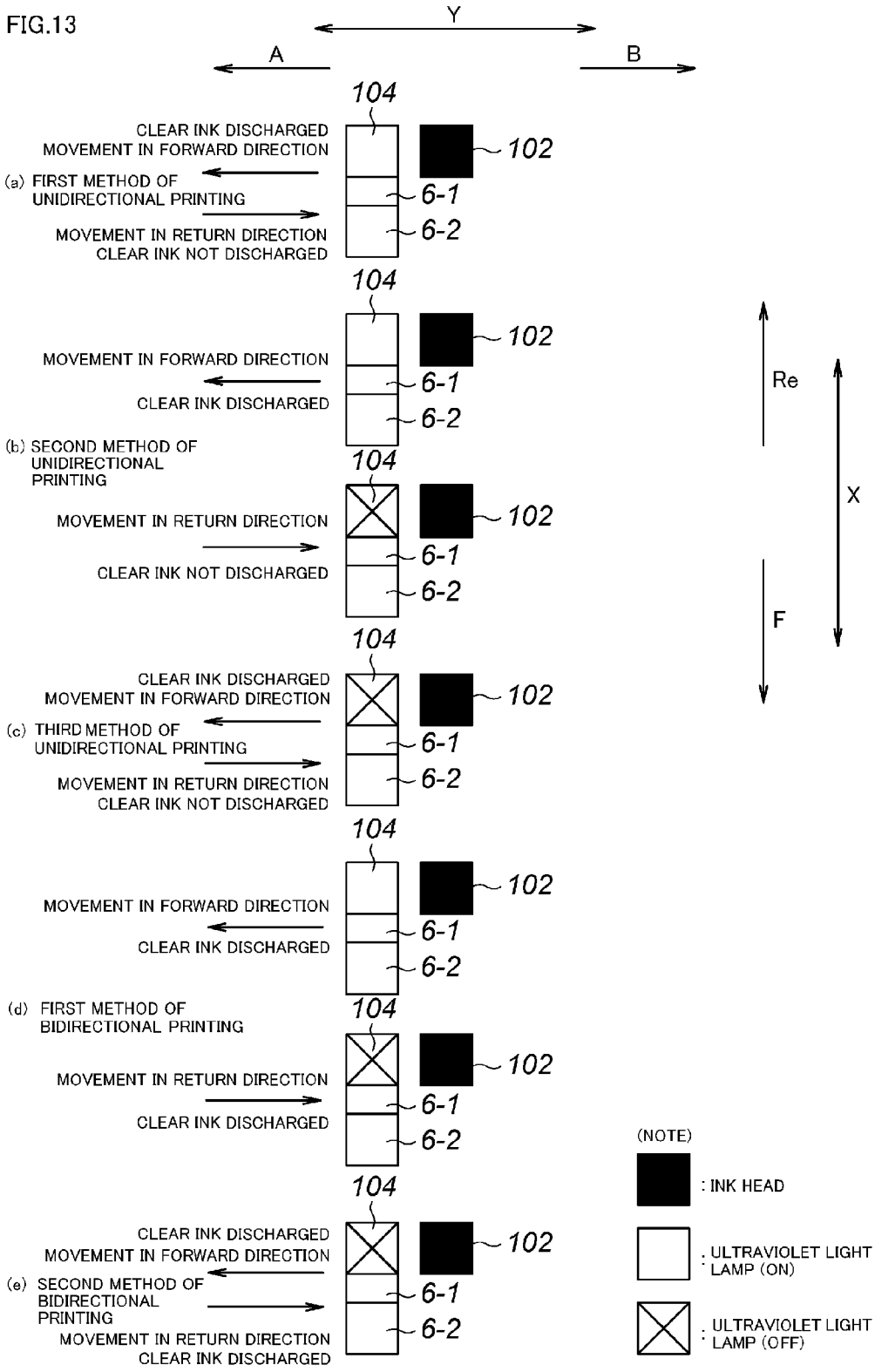
FIG. 13 illustrates illumination states of the light emitting devices according to one embodiment of the present invention.

For example, as illustrated in FIG. 13(*a*), in the first method of unidirectional printing, the first ultraviolet lamp 104 and the second ultraviolet lamp 6-2 are both lit when moving in the forward direction A and when moving in the return direction B. As illustrated in FIG. 13(*b*), in the second method of unidirectional printing, the first ultraviolet lamp 104 is lit when moving in the forward direction A, and the first ultraviolet lamp 104 is turned off when moving in the return direction B. The second ultraviolet lamp 6-2 is lit when moving in the forward direction A and when moving in the return direction B. As illustrated in FIG. 13(*c*), in the third method of unidirectional printing, the first ultraviolet lamp 104 is turned off and the second ultraviolet lamp 6-2 is lit when moving in the forward direction A and when moving in the return direction B.

As illustrated in FIG. 13(*d*), in the first method of bidirectional printing, the first ultraviolet lamp 104 is lit when moving in the forward direction A, and the first ultraviolet lamp 104 is turned off when moving in the return direction B. The second ultraviolet lamp 6-2 is lit when moving in the forward direction A and when moving in the return direction B. As illustrated in FIG. 13(*e*), in the second method of bidirectional printing, the first ultraviolet lamp 104 is turned off and the second ultraviolet lamp 6-2 is lit when moving in the forward direction A and when moving in the return direction B.

In the foregoing embodiments, the output of light, such as ultraviolet light, to the clear ink has been described in detail. However, the present invention is not limited thereto. For other inks, the timing for the output of light may be changed as needed. The ink discharged by the ink head 102 is not limited to the above-described inks, but may include other inks For example, the ink head 102 may discharge various ink colors such as gold, silver, or the like.

The foregoing embodiments describe performing the first printing step and the second printing step. However it is also possible to perform only the first printing step. Alternatively, it is possible to perform only the second printing step. Specifically, it is possible to print the clear ink directly onto the recording paper 200 without outputting process color inks and white ink.

Moreover, the variations of arrangement of the first and second light emitting devices are not limited to the foregoing embodiments.

Furthermore, in the foregoing embodiments, the second ultraviolet lamp or the ultraviolet lamp unit that serves as the second light emitting device is configured to move integrally with the ink head 102. This configuration has the advantage that ultraviolet light can be applied only to the necessary location. However, this configuration is not necessarily essential, and for example, it is possible to fix the second light emitting device to the apparatus main unit 101.

Moreover, the foregoing embodiments disclose that the ultraviolet lamp and the ultraviolet lamp unit can emit ultraviolet light as the first and second light emitting devices. However, it is possible to use LEDs, and other ultraviolet lights, as the light emitting devices. In addition, it is possible to change the light emitting devices depending on the type of the photo-curing ink. For example, the light emitting devices may be constructed by a device that can emit different radiation rays other than ultraviolet light, such as visible light, electron beam rays, or other types of light.

Furthermore, the front-to-rear length of the light emitting portion of each of the ultraviolet lamps and the ultraviolet lamp units and that of the printing area 103*d* of the print head 103 may be set to a length which differs from the size L.

In the foregoing embodiments, the ultraviolet lamp and the ultraviolet lamp unit serving as the second light emitting device are lit at all times. However, it is possible that the second light emitting device may be turned on and off as necessary.

It is possible that the number of the print heads 103 of the ink head 102 may be varied as appropriate depending on, for example, the type of printing. For example, when performing monochromatic printing or clear printing, the ink head 102 may have only one print head 103.

In addition, the present invention can be applied to printing that is performed on a portion of the recording medium.

The term "inkjet recording apparatus" means apparatuses that perform inkjet-type recording in general. The term "inkjet recording apparatus" encompasses various other types of recording apparatuses other than the inkjet printer, such as facsimile machines.

The invention claimed is:

1. An inkjet recording apparatus comprising:

an ink head configured to move in left and right directions and comprising a plurality of nozzles arranged in a front-rear direction in order to discharge ink on a recording medium, wherein the ink is curable when irradiated with light from a first light emitting device or a second light emitting device;

a conveyor device configured to move the recording medium;

a control device configured to at least perform a first printing operation by controlling the first light emitting device to be turned on when the ink head discharges the ink or perform a second printing operation by controlling the first light emitting device to be turned off and the second light emitting device to be turned on when the ink head discharges the ink, wherein the first light emitting device is configured to move integrally with the ink head in order to apply light to the recording medium, and wherein the second light emitting device is positioned such that it is offset from the plurality of nozzles in the front-rear direction and configured to turn on independent of the first light emitting device in order to apply light to the recording medium.

2. The inkjet recording apparatus according to claim 1, wherein a length of a light emitting portion of the first light emitting device is equal to the length between a frontmost nozzle of the plurality of nozzles and a rearmost nozzle of the plurality of nozzles.

3. The inkjet recording apparatus according to claim 2, wherein a length of a light emitting portion of the second light emitting device is equal to the length between a frontmost nozzle of the plurality of nozzles and a rearmost nozzle of the plurality of nozzles.

4. The inkjet recording apparatus according to claim 1, wherein an edge of a light emitting portion of the second light emitting device is linearly parallel with an edge of a light emitting portion of the first light emitting device.

5. The inkjet recording apparatus according to claim 1, wherein:

the conveyor device is further configured to move the recording medium frontward by a length equal to or greater than a predetermined minimum feed amount when performing a print operation; and an edge of a light emitting portion of the second light emitting device nearest to the plurality of nozzles is offset from an edge of a light emitting portion of the first light emitting device by a distance greater than the predetermined minimum feed amount.

6. The inkjet recording apparatus according to claim 1, wherein the second light emitting device is further configured to move integrally with the ink head.

7. The inkjet recording apparatus according to claim 6, wherein:

the first light emitting device is positioned to a left side or right side of the ink head; and the second light emitting device is positioned on a side opposite to the position of the first light emitting device.

8. The inkjet recording apparatus according to claim 1, wherein:

the conveyor device is further configured to move the recording medium rearward; and the control device is further configured to turn off the first light emitting and second light emitting device while the recording medium is being moved rearward.

9. The inkjet recording apparatus according to claim 1, wherein the ink head further comprises:

a first print head configured to discharge first ink; and a second print head configured to discharge second ink, wherein the first ink is different from the second ink.

10. The inkjet recording apparatus according to claim 9, further comprising a control device configured to at least:

perform the first printing operation by discharging the first ink via the first print head and turning on the first light emitting device; or perform the second printing operation by discharging the second ink via the second print head, turning off the first light emitting device and turning on the second light emitting device ink.

11. An inkjet recording apparatus, comprising:

an ink head configured to move in left and right directions and comprising a plurality of nozzles arranged in a front-rear direction in order to discharge ink on a recording medium, wherein the ink is curable when irradiated with light from a first light emitting device or a second light emitting device; and a conveyor device configured to move the recording medium;

wherein the first light emitting device is configured to move integrally with the ink head in order to apply light to the recording medium, wherein the second light emitting device is positioned such that it is offset from the plurality of nozzles in the front-rear direction and configured to turn on independent of the first light emitting device in order to apply light to the recording medium, wherein the ink head comprises:

a first print head configured to discharge first ink; and a second print head configured to discharge second ink, wherein the first ink is different from the second ink, and wherein the conveyor device is further configured to move the recording medium rearward.

12. The inkjet recording apparatus according to claim 11, further comprising:

a control device configured to:

control the ink head to move in a left and right direction;

control the first print head to discharge the first ink while turning on the first light emitting device and moving the recording medium frontward by a predetermined front feed amount;

move the recording medium rearward by a predetermined rear feed amount;

control the ink head to move back and forth a plurality of times in the left and right directions and control the second print head to discharge the second ink while turning on the first light emitting device and moving the recording medium frontward by the predetermined front feed amount;

move the recording medium rearward; and control the ink head to move in the left and right directions, control the second print head to discharge the second ink while turning off the first light emitting device and turning on the second light emitting device and to move the recording medium frontward by a predetermined front feed amount.

13. An inkjet recording apparatus, comprising:

an ink head configured to move in left and right directions and comprising a plurality of nozzles arranged in a front-rear direction in order to discharge ink on a recording medium, wherein the ink is curable when irradiated with light from a first light emitting device or a second light emitting device;

a conveyor device configured to move the recording medium;

a control device configured to:

perform a first printing operation by turning off the first light emitting device and turning on the second light emitting device when the ink head discharges the ink; and perform a second printing operation by turning on the first light emitting device when the ink head discharges the ink, wherein the first light emitting device is positioned on the left side or the right side of the ink head and configured to move integrally with the ink head in order to apply light to the recording medium, wherein the second light emitting device is positioned on the side opposite to the position of the ink head such that it is offset from the plurality of nozzles in the front-rear direction and is configured to turn on independent of the first light emitting device in order to apply light to the recording medium.

14. An inkjet recording apparatus comprising:

an ink head configured to move in left and right directions and comprising:

a plurality of nozzles arranged in a front-rear direction in order to discharge ink on a recording medium, wherein the ink is curable when irradiated with ultraviolet light;

a first print head configured to discharge first ink; and a second print head configured to discharge second ink, wherein the first ink is different from the second ink;

a conveyor device configured to move the recording medium frontward by a predetermined feed amount;

a first light emitting device positioned linearly adjacent to the plurality of nozzles and configured to move integrally with the ink head in order to apply ultraviolet light to the recording medium;

a second light emitting device positioned such that it is offset from the plurality of nozzles in the front-rear direction and configured to move integrally with the ink head and turn on independently of the first light emitting device in order to apply ultraviolet light to the ink discharged from the ink head after the recording medium has been moved frontward by the predetermined feed amount; and a control device configured to at least:

perform a first printing step by discharging the first ink via the first print head and turning on the first light emitting device; or perform a second printing step by discharging the second ink via the second print head, turning off the first light emitting device and turning on the second light emitting device.

15. The inkjet recording apparatus according to claim 14, wherein a length of a light emitting portion of the first light emitting device is equal to a length between a frontmost nozzle of the plurality of nozzles and a rearmost nozzle of the plurality of nozzles.

16. The inkjet recording apparatus according to claim 15, wherein a length of a light emitting portion of the second light emitting device is equal to the length between a frontmost nozzle of the plurality of nozzles and a rearmost nozzle of the plurality of nozzles.

* * * * *